US008444334B2

(12) United States Patent
Cardia

(10) Patent No.: US 8,444,334 B2
(45) Date of Patent: May 21, 2013

(54) CONTAINER FOR THE MOTION OF A DOUBLE STICK WITH A SINGLE STICK HOLDER

(75) Inventor: Ennio Cardia, Rome (IT)

(73) Assignees: Ennio Cardia, Rome (IT); Laura Cardia, Rome (IT); Anna Maria Ballarati, Rome (IT)

( * ) Notice: Subject to any disclaimer, the term of this patent is extended or adjusted under 35 U.S.C. 154(b) by 355 days.

(21) Appl. No.: 12/812,103

(22) PCT Filed: Jan. 7, 2009

(86) PCT No.: PCT/IT2009/000004

§ 371 (c)(1),
(2), (4) Date: Jul. 8, 2010

(87) PCT Pub. No.: WO2009/090680

PCT Pub. Date: Jul. 23, 2009

(65) Prior Publication Data

US 2010/0284724 A1 Nov. 11, 2010

(30) Foreign Application Priority Data

Jan. 14, 2008 (IT) ..... RM08A0019

(51) Int. Cl.
*B43K 27/00* (2006.01)

(52) U.S. Cl.
USPC ..... 401/30; 401/34; 132/318

(58) Field of Classification Search
USPC 401/29, 30, 34, 56, 27, 85, 89, 112; 132/318; 206/385
See application file for complete search history.

(56) References Cited

U.S. PATENT DOCUMENTS

| | | | | | |
|---|---|---|---|---|---|
| 2,113,861 | A | * | 4/1938 | Segal | 401/30 |
| 2,177,651 | A | * | 10/1939 | Harris | 401/19 |
| 2,219,000 | A | * | 10/1940 | Williams | 401/29 |
| 2,636,598 | A | * | 4/1953 | Hopgood | 401/30 |
| 2,657,411 | A | * | 11/1953 | Becker | 15/184 |
| 2,710,614 | A | | 6/1955 | Dulberg | |

(Continued)

FOREIGN PATENT DOCUMENTS

| | | |
|---|---|---|
| DE | 28 31 937 | 2/1980 |
| FR | 604 977 | 5/1926 |
| FR | 999 250 | 1/1952 |

OTHER PUBLICATIONS

International Search Report dated Aug. 6, 2009, from corresponding PCT application.

*Primary Examiner* — Huyen Le
*Assistant Examiner* — Jennifer C Chiang
(74) *Attorney, Agent, or Firm* — Young & Thompson

(57) ABSTRACT

A container with a roto-translatory motion of a stick holder (1) provided with a pair of opposed sticks (3, 3') in comparison with the support surface plane (4) and upper (5) and lower (5') pins, that axially slide inside an intermediate body (7), provided with vertical grooves (11, 11') inside its central wall (10) and slits (8, 8') and (9, 9') on its upper (7') and lower (7") portions rotating in the inside of a pair of outer bodies (13, 13'). The pins (5, 5') slide inside annular grooves (14, 14'), helicoidal groove (16, 16') and (17, 17') made in the inner wall of these outer bodies (13, 13'), such that the pair of sticks (3, 3') can be controlled to come out from both ends, upper (7') and lower (7") portions of the intermediate body, when the ends are apart from the respective caps/bases (22, 22') of covering.

15 Claims, 3 Drawing Sheets

U.S. PATENT DOCUMENTS

| | | | | |
|---|---|---|---|---|
| 2,964,170 | A * | 12/1960 | Otto et al. | 401/78 |
| 3,001,531 | A * | 9/1961 | Gazdik | 401/49 |
| 5,056,179 | A * | 10/1991 | Capponi | 15/105 |
| 6,290,413 | B1 * | 9/2001 | Wang | 401/30 |
| 6,345,922 | B2 * | 2/2002 | Tani | 401/32 |
| 6,973,932 | B2 * | 12/2005 | Ko | 132/309 |
| 7,390,137 | B1 * | 6/2008 | Rentz | 401/112 |
| 2008/0166172 | A1 * | 7/2008 | Eng et al. | 401/37 |

* cited by examiner

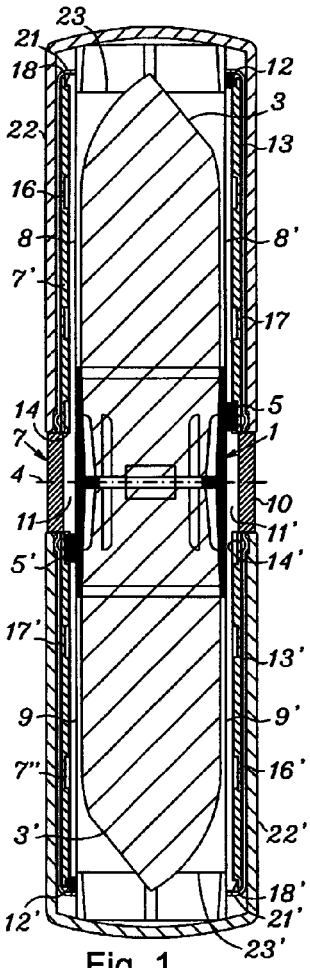
Fig. 1
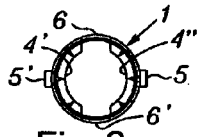
Fig. 2a
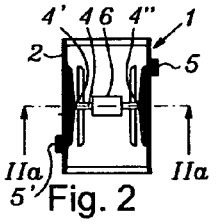
Fig. 2
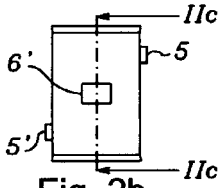
Fig. 2b
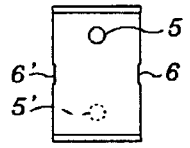
Fig. 2c
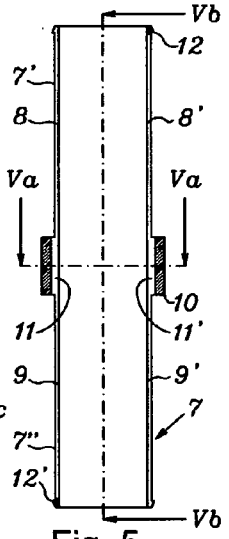
Fig. 5
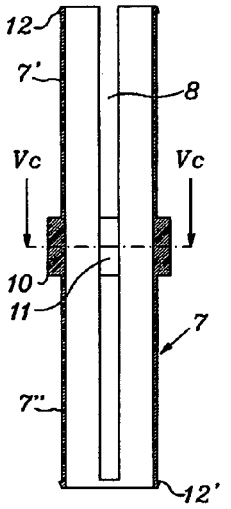
Fig. 5b
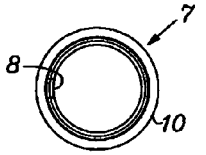
Fig. 5a
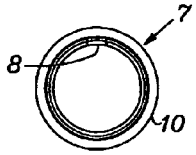
Fig. 5c
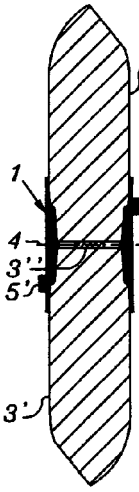
Fig. 3
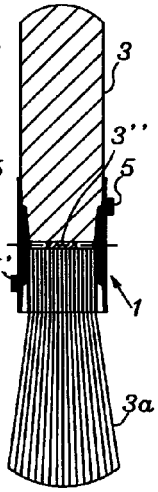
Fig. 4
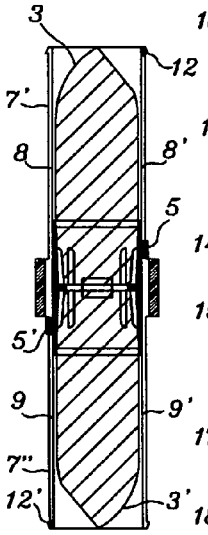
Fig. 6
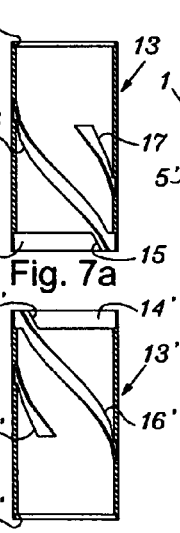
Fig. 7a
Fig. 7b
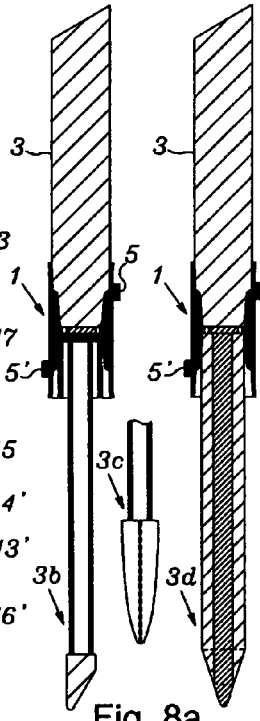
Fig. 8
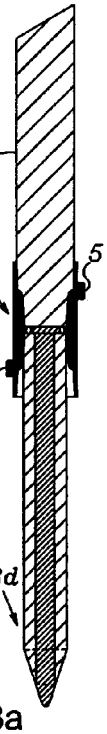
Fig. 8a
Fig. 9

CONTAINER FOR THE MOTION OF A DOUBLE STICK WITH A SINGLE STICK HOLDER

The invention consists in a container for the motion of a double stick with a single stick holder, mostly for cosmetic use, for example for stick products, by which the stick holder body is controlled with a roto-translatory motion that alternatively makes both container ends come out, when each end is free from its caps.

Such a container is useful for controlling, with only one mechanism, the motion of two identical sticks, similar or different from each other or of a stick from one side and an instrumental cosmetic applicator to the other, for example: brush, sponge, eyeliner, mascara, pencil, etc., where the stick products could be: red for lips, lip-pomade, cheek product, eyes area product, lead, deodorant products, body product, and similar, etc.

It is known that there are containers on the market that are capable of controlling two products in sticks, for example red for lips, made with two containers, each provided with its separate mechanism, opposite to each other and made integral, so having independent mechanism between them.

The present invention differs from the preceding artworks because it is provided with an only mechanism that allows to have the motion of a single stick holder towards opposite ends compared with its central area, a non usable area that is usually utilized for the closure of both caps, therefore both sticks, in an opposite position, move together in both ends, where if one stick comes out the other follows sliding in the inside of the container.

The present invention allows to have, in respect to the preceding artworks, a noticeable price savings, the price due to less number of pieces used and also thanks to a reduced total of length/height, because it is provided with a single stick holder and an only intermediate body, instead of two stick holders and of two intermediate bodies.

Preferred forms for the realization of the container, according to the invention, are described in the claims and in the attached figures of the designs, with plans indicated in Roman numerals, by which:

FIG. 1 illustrates, in a front section view, the roto-translatory mechanism of the container with both double caps/bases inserted in a closed opposing position on both the upper and lower portion of the container.

FIG. 2 illustrates, in a front section view, the body of the stick holder with a pair of guide pins opposed in the vertical axle as well as in the central plane.

FIG. 2*a* illustrates the plan view, according to the central plan IIa-IIa, of the stick holder of FIG. 2.

FIG. 2*b* illustrates the outer view of the stick holder of FIG. 2.

FIG. 2*c* illustrates the outer view stick holder, rotated at 90°, according to plan IIc-IIc of FIG. 2*b*.

FIGS. 3 and 4 illustrate, in a front section view, the stick holder provided with a opposed stick, in comparison with the central level, respectively to a second stick or to a cosmetic brush.

FIG. 5 illustrates, in a front section view, the intermediate body, tubular, with guide slits opposed in comparison to the plan Va-Va.

FIG. 5*a* illustrates, in a plan view, according to the Va-Va plan, the intermediate body of FIG. 5.

FIG. 5*b* illustrates, in a front section view, the intermediate body of FIG. 5, rotated at 90°, according to the plan Vb-Vb.

FIG. 5*c* illustrates, in a plan view, according to plan Vc-Vc, the intermediate body of FIG. 5*b*.

FIG. 6 illustrates, in a front section view, the stick holder, with a pair of opposed sticks, of FIG. 3 assembled inside of the intermediate body of FIG. 5.

FIGS. 7*a* and 7*b* illustrate, in a front section view, a pair of outer bodies, tubulars, with internal helicoidal grooves, same, separate and put in a opposed position.

FIGS. 8, 8*a* and 9 illustrate, in a front section view, the stick holder provided with a stick in the form of a style, of reduced diameter, opposed with an instrument applicator of cosmetic products, respectively a small bar with sponge, a small bar with mascara brush or eye-pencil.

Figure 10:
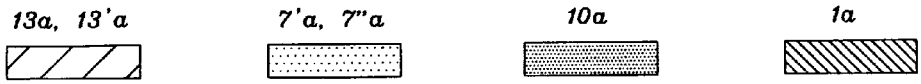

FIG. 10 illustrates portions of sections used to illustrate the development plane of the circumference of the inner walls of the roto-translatory mechanism: pair of outer bodies, intermediate body, and stick holder.

Figure 11:
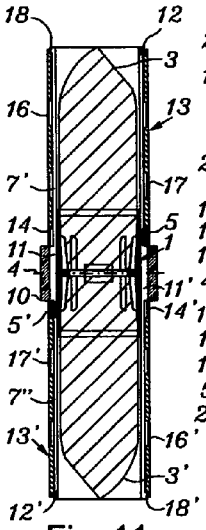

FIG. 11 illustrates, in a front section view, the roto-translatory mechanism made by assembling bodies of FIG. 6 with the outer bodies of FIGS. 7*a* and 7*b*.

Figure 11A:
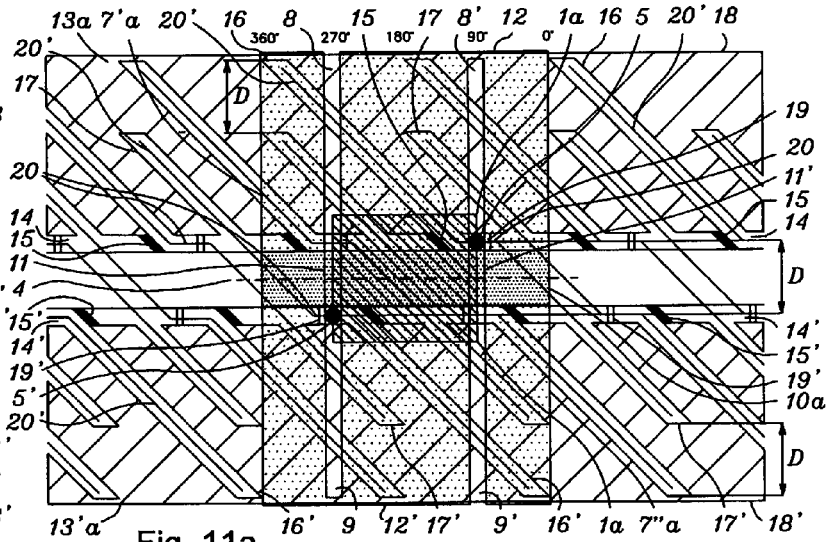

FIG. 11*a* illustrates the development plane of the circumferences of the inner walls telescopically superimposed of the roto-translatory mechanism according to FIG. 11.

Figure 12:
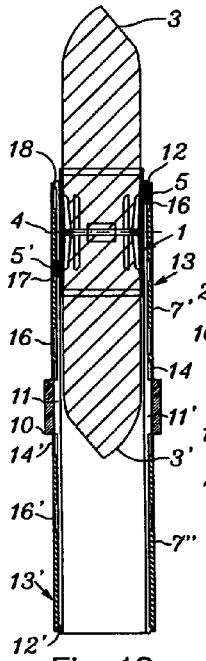
Figure 13:
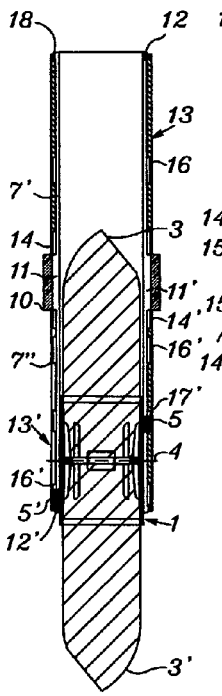

FIGS. 12 and 13 illustrate, in a front section view, the roto-translatory mechanism of FIG. 11 in the position of which the stick holder of FIG. 3, provided with the respective pair of opposite sticks, is completely roto-translated respectively through its upper or lower end.

Figure 12A:
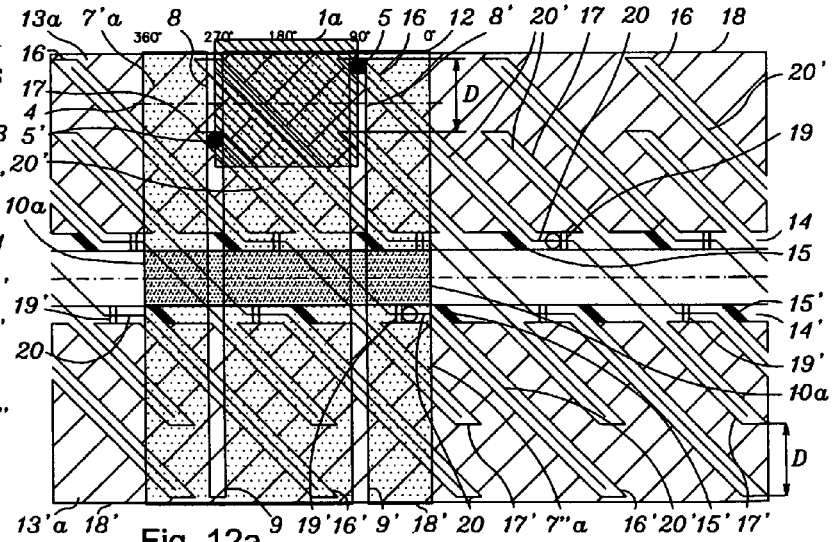
Figure 13A:
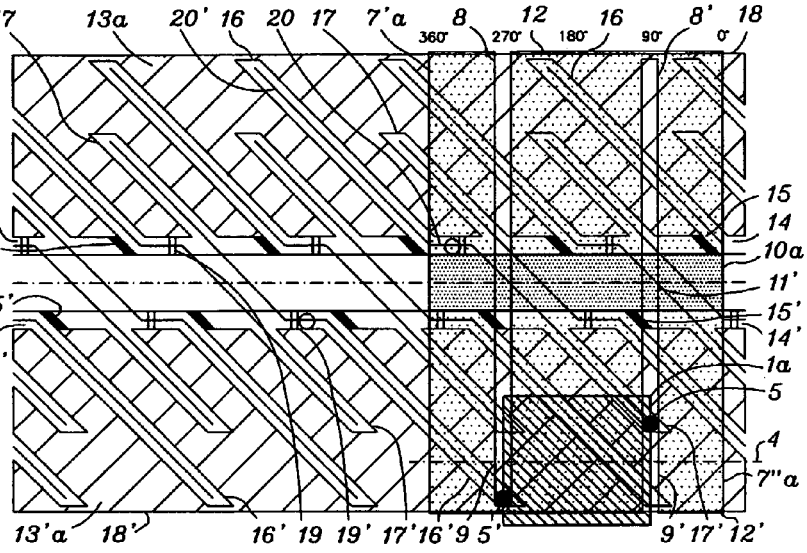

FIGS. 12*a* and 13*a* illustrate the plane development of the circumference of the inner walls of the roto-translatory mechanism respectively based on FIG. 12 or 13.

Figure 14:
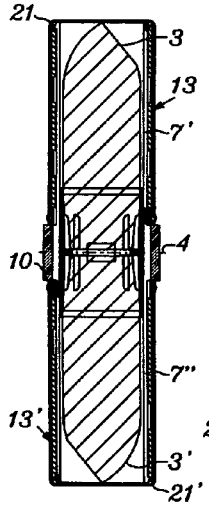

FIG. 14 illustrates, in a front section view, the roto-translatory mechanism of FIG. 11 where the pair of outer bodies are covered with metal shells of covering.

Figure 15:
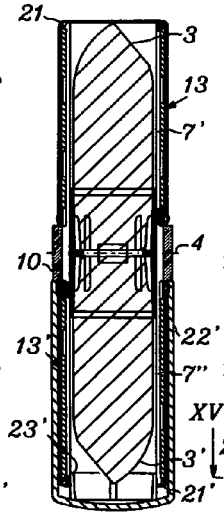

FIG. 15 illustrates, in a front section view, the roto-translatory mechanism of FIG. 14 with one of the two caps/bases, inserted in a closing position in the lower portion of the container.

Figure 16:
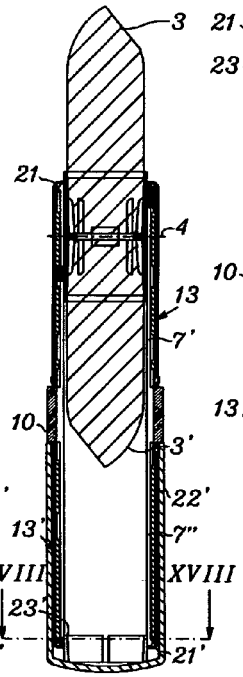

FIG. 16 illustrates, in a front section view, the roto-translatory mechanism of FIG. 15 when the stick holder, with both double sticks, is completely roto-translated through the upper end of the container, in a position of complete upper discharge.

Figure 17:
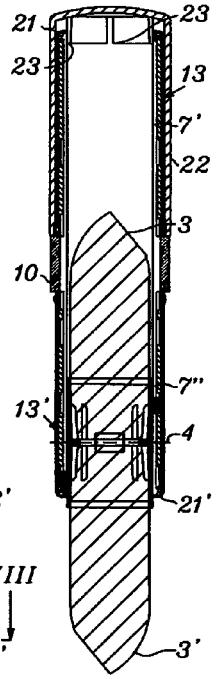

FIG. 17 illustrates, in a front section view, the roto-translatory mechanism of FIG. 14 with one of the two caps/bases, inserted in a closing position in the upper portion of the container, where the stick holder, with both double sticks, is completely roto-translated through the lower end of the container, showing the lower stick in a position of complete lower discharge.

Figure 18:
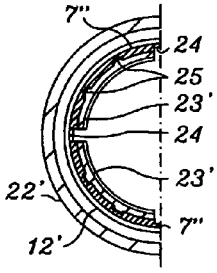

FIG. 18 illustrates the plain view, only the left half, enlarged with scale 2:1, according to the XVIII-XVIII plan, of the only two bodies lower cap and lower end of FIG. 16 inner body, to simplify the representation the metal tubular shell bodies and the outer lower body are not illustrated.

In FIGS. 1, 2, 2*a*, 2*b*, 2*c* and 3, the stick holder 1 has a tubular body 2, with both ends open, and of a central plan of support surface 4 of respective double sticks of cosmetic products 3 and 3', consists in two opposed portions of annular edges 4 and 4' directed through the axle, and at least of a pair of pins guide, upper 5, and lower 5', made on the outer wall of tubular body 2, arranged in opposite position in respect to the axle, with a definite distance, in respect to the central plane of the supporting surface 4 of the double sticks.

Two opposite openings 6 and 6' obtained between the two opposed positions of annular edges 4 and 4', that function as air discharge when each end of the two sticks 3 and 3' are inserted to lean on these double opposed portions of annular edges.

On the inner wall of the tubular body 2 there can be obtained, along its circumference, vertical ribs to anchor in a stable position the two bottoms opposed sticks.

FIG. 4 illustrates the variation of FIG. 3, where the stick of cosmetic product 3 has been contrasted with an application tool of cosmetic product 3*a*, consisting for example in a brush for cosmetic use.

To better anchor in a stable position the two opposed bottoms of sticks 3, 3', or of stick 3 with a opposed application tool of the cosmetic product 3*a*, could be useful, during the assembling operation, interposing between the two bottoms, a solid product 3", for example non-limitative in:

a) a dripping of the melted cosmetic product, that amalgamates with the two stick bottoms of the same cosmetic product, creating a single body during its cooling, b) an amalgam of different product that has in any case the purpose to create a single body with both bottoms of the sticks. FIGS. 5, 5*a*, 5*b*, and 5*c* illustrate the intermediate body 7, tubular, provided with:

- a pair of guide slits 8 and 8', opposite, verticals, realised on its portion of upper tubular wall 7', of minor diameter;
- a pair of guide slits 9 and 9', opposite, verticals, realised on its portion of lower tubular wall 7", of minor diameter;
- a central wall 10, of wider outer diameter, on its central tubular wall 7, where the pair slits 8, 8' and 9, 9' are symmetrical in comparison with said central wall 10;
- a pair of guide grooves 11 and 11', opposite, vertical, realised inside said central Wall 10, in line with pairs of guide slits 8, 8' and 9, 9';
- outer annular teeth, upper 12 and lower 12', provided on the open ends of the wall portions 7' upper and 7" lower of the intermediate body 7, where the upper 12 is cut from at least a upper slit 8, the lower one 12' is cut from at least an lower slit 9'.

FIG. 6 illustrates the assemblage of the stick holder 1, provided with opposed double sticks 3 and 3' of FIG. 3 and inside the intermediate body 7 of FIG. 5, where the lower pin 5' is provided in the lower slit 9 while the upper pin 5 is provided in the upper slit 8'.

FIGS. 7*a* and 7*b* illustrate a pair of outer bodies, upper 13 and lower 13', tubular with open ends, same, separated and put in opposed position, provided of:

- a pair of portions of internal annular grooves 14 and 14', interrupted by internal respective relieves in the shape of an inclined tooth 15 and 15';
- a pair of helicoidal internal grooves 16 and 16';
- a pair of helicoidal internal grooves 17 and 17', asymmetrically opposite to the pair of internal helicoidal grooves 16 and 16'.

In the figures it is illustrated a container with suitable proportions for a pair of sticks 3, 3' of cosmetic product for lips.

Changing the proportions of the stick holder 1, reducing its diameter, as illustrated in FIG. 8, it can be made a container for stick 3 in the shape of a style, or a lead, of reduced diameter and lengthened shape, suitable for lips or eyes area, eventually with an application tool of opposed cosmetic product, that consists in a small bar provided with a small sponge 3*b* or, as illustrated in FIG. 8*a*, a small bar provided with a mascara 3*c*, or as illustrated in FIG. 9, of a lead 3*d*, or of a small brush, or similar tools for the application of a cosmetic product, where these last eventual variations are not illustrated in the attached designs.

Changing the proportions of the stick holder 1, increasing its diameter, it can also be made a container for stick 3 of large diameter and lengthened shape suitable for cheeks or body area, eventually with an application tool of opposed cosmetic product, that consists in a brush 3*a* or eventually with a small body sponge, where said last eventual application tool variation is not illustrated in the attached designs.

FIG. 10 illustrates portions of sections used to distinguish the plane development of the circumference of the inner walls of the roto-translatory mechanism:

- a pair of outer bodies, upper 13*a* and lower 13'*a*, with inclined hatched spaced at 0°,
- intermediate body, upper 7'*a*, lower 7"*a*, hatched with spaced dots,
- central wall 10*a* of the intermediate body 7, positioned between the upper 7'*a* and lower 7"*a* portions, with dense hatched dots,
- stick holder 1*a*, with inclined hatched dense at 90°.

FIG. 11 illustrates, in a front section view, the roto-translatory drive mechanism obtained through the assemblage of the bodies of FIG. 6 with the outer bodies of FIGS. 7*a* and 7*b*.

FIG. 11*a* illustrates the plane development of the circumference of the inner walls of the roto-translatory drive mechanism according to FIG. 11.

The plane development of the circumference of the inner walls of the pair of outer bodies, upper 13 and lower 13', of FIGS. 7*a* and 7*b*, same, separated and put in a opposed position, are represented by surfaces, respectively upper 13*a* and lower 13'*a*, that in the figure, to be clear, are developed as a multiple, equal to 2,5, of 360° and are provided with grooves realised in each internal tubular walls, which are:

- a pair of portion of annular grooves 14 and 14' adjacent to each open end faced towards the central wall 10*a*, interrupted by respective internal relieves, for example in the shape of an inclined tooth 15 and 15';
- a pair of helicoidal internal grooves 16 and 16' with ends that:

a) from one side they cross the pair of annular grooves 14 and 14', in an adjacent position towards the internal relieves in the shape of an inclined tooth 15 and 15', so that a side of the inclined tooth 15 or 15' is the continuation of the side of the helicoidal groove 16 or 16', b) on the other side they stop at a final distance a bit before the internal annular steps 18 and 18', adjacent to each open end faced towards the outside;

- a pair of helicoidal internal grooves 17 and 17' asymmetrically opposite to the pair of helicoidal internal grooves 16 and 16', with ends that:

a) from one side they cross the pair of annular grooves 14 and 14', b) on the other side they stop at a final distance a bit before the internal annular steps 18 and 18', said final distance lower of a distance "D" in respect to the final one of the pair of the helicoidal internal groove 16 or 16' and equal to the distance "D" between the guide pins pair 5 and 5'.

On the plane development of the circumference of the inner walls of the pair of upper outer bodies 13 and lower 13', its superimposes the plane development of the circumference of the inner wall of the intermediate body 7 and of the central wall 10, of FIGS. 5, 5*a*, 5*b*, and 5*c*.

These plan developments are represented from a surface that develops up to 360°, and indicated with:

- 7'*a*, upper portion, of minor outer diameter, provided with a pair of guide slits opposite upper 8 and 8', verticals,
- 7"*a* lower portion, of minor outer diameter, provided with a pair of guide slits opposite lower 9 and 9', verticals,
- 10*a* central wall, that keeps a distance from the pair of upper and lower portions 7', 7", of major outer diameter, provided with grooves 11 and 11', verticals, in line and in continuing of these pair of guide slits opposite 8 and 8' and 9, 9', realised in the internal tubular wall.

Slit 8 cuts the upper outer annular tooth 12, provided in correspondence with the upper end of the plane development 7'*a* upper of the circumference of the internal wall of the intermediate body 7, while the lower slit 9 extends as a near limit of the lower outer annular tooth 12', without cutting it.

Symmetrically slit 9' cuts the lower outer annular tooth 12', provided in correspondence to the lower end of the plane development 7"*a* lower of the circumference of the inner wall of the intermediate body 7, while the upper slit 8' extends as a close limit of the upper outer annular tooth 12, without cutting it.

On the plane development of the circumference of the inner wall of the intermediate body 7, superimposes the plane development of the circumference of the inner wall of the stick holder 1 of FIGS. 2, 2*a*, 2*b*, 2*c* and 3.

Said plane development being designed without the two opposing portions of annular edges 4 and 4', without the opposite openings 6 and 6' and without the opposed sticks 3 and 3'. It is represented by a surface that develops up to 180°, and indicated with the reference 1*a* and is provided with a pair of guide pins 5 and 5', arranged in opposed position with a distance of "D/2" in comparison with the central level of the support surface 4, so that the pin of guide 5' be in an lower position and the opposed pin of guide 5 be in a upper position.

In FIG. 11 the stick holder 1 is represented in the centre of the roto-translatory mechanism in its position of non-use with the two opposed sticks 3 an 3' both put in an internal position.

Correspondingly in FIG. 11*a* the lower pin of guide 5' is positioned in a way that it crosses the lower guide slits 9 of the lower intermediate body 7"*a* to get inserted into the lower annular grooves 14' of the lower outer body 13'*a*, while the upper pin of guide 5 is positioned in a way that it crosses the upper guide slits 8' of the upper intermediate body 7'*a* to get inserted in the upper annular groove 14 of the upper outer body 13*a*. It is made, in said position of exchange, the possibility for the stick holder to be controlled to move towards the upper or the lower ends.

When the pin of guides 5 and 5' slide in the annular grooves 14 and 14', not until the inclined teeth 15, 15' meet, the stick holder 1 has no possibility of moving vertically in one direction or the other.

To avoid that the stick holder in a non-use position could be free to accidentally move on the axle, stopping means have been made, surmountable with a control of mutual rotation between one of the two outer tubular bodies 13*a* or 13'*a* and the central wall 10, consisting in, at least one, slight relieves 19 and 19' made inside the annular groove 14 and 14' in an outer position and adjacent to the guide pins 5 and 5' in a non-use position.

If mutual rotating motions are impressed between the outer tubular bodies 13, or 13' and the central wall 10 in the roto-translatory control mechanism of FIG. 11, the line of translational sliding can be analyzed, horizontal 20, inclined 20', of the guide pins 5 and 5', and therefore of the relative motion of the stick holder 1, through the slits and the grooves represented on the plane development of the circumference of the inner walls of the roto-translatory control mechanism of FIG. 11*a*.

If, for example, a mutual rotating motion is impressed between the outer upper body 13 and the central wall 10 of FIG. 11 in a way that, as it is illustrated in FIG. 11*a*, the central wall 10*a* and the respective portions, upper 7'*a* and lower 7"*a*, of the intermediate body, they move towards the left, we obtain that:

a) the upper pin 5 covers a brief distance of horizontal translatory sliding 20, along the upper annular groove 14 of the outer upper body 13*a*, standing still without a vertical translation inside the upper slit 8' of the intermediate upper body 7'*a*, to meet in its way the inclined tooth 15. Said inclined tooth 15 modifies the path of the upper pin 5 on the inclined translatory sliding 20' line, along the helicoidal groove 16 of the upper outer body 13*a*, with a corresponding beginning of vertical translation towards the top, inside the upper slit 8';

b) correspondingly, the lower pin 5' covers the same brief distance of horizontal translatory sliding 20, along the lower annular groove 14' of the outer lower body 13'*a*, standing still without a vertical translation inside the lower slit 9 of the lower intermediate body 7"*a*, to follow parallely, controlled by the other upper pin 5, the same distance of the translatory sliding inclined 20' line along the free area between the pair of the outer bodies 13 and 13'*a*, with a corresponding beginning of vertical translation towards the top, inside groove 11 of the central wall 10*a*, then slides along the helicoidal groove 17 of the upper outer body 13*a*, with a corresponding vertical translation towards the top, inside the upper slit 8.

Continuing the move towards the left we obtain, as illustrated in FIGS. 12 and 12*a*, that:

a) the upper pin 5 stops at the upper limit of the helicoidal groove 16, adjacent to the internal annular step 18 of the upper outer body 13*a*, and near the upper outer annular tooth 12 of the upper intermediate body 7'*a;* b) correspondingly, the lower pin 5' stops at the upper limit of the helicoidal groove 17, of an lower height equal to the distance "D" in comparison with the upper limit of the helicoidal groove 16.

In that position the stick holder 1 is completely translated towards the top, with its upper edge projected in comparison with the upper outer annular tooth 12 of the upper intermediate body 7'*a*, with its stick 3 completely out in upper position, while the opposed stick 3' stays in an internal position to the upper intermediate body 7'*a*.

Inverting the motion towards the right, of the central wall 10*a* and of the respective portions, upper 7'*a* and lower 7"*a*, of the intermediate body, with a mutual rotating motion in comparison with the upper outer tubular body 13, we obtain that pins 5 and 5', and the relative stick holder 1, lower along the respective annular grooves 16 and 17, and upper vertical slits 8' and 8, turn back to the starting point, as it is illustrated in FIGS. 11 and 11*a*.

Continuing the motion towards the right, of the central wall 10*a* and of its portions, upper 7'*a* and lower 7"*a*, of the intermediate body, besides the non-use position, and forcing the slight relieves 19 and 19' made inside the annular grooves 14 and 14', the guide pins 5 *e* 5' cover, along these internal annular grooves 14 and 14', the horizontal lines of translational sliding 20 until they meet, to stop however, the inclined tooth 15.

If instead, for example, a mutual rotating motion is impressed between the lower outer tubular body 13' and the central wall 10 and its intermediate body, upper portion 7', lower portion 7", of FIG. 11 so that, as it is illustrated in FIG. 11*a*, the central wall 10*a* and the respective portions, upper 7'*a* and lower 7"*a*, of the intermediate body move towards the right, we obtain that:

a) the lower pin 5' covers a brief distance of translatory sliding horizontal 20, along the lower annular groove 14' of the outer lower body 13'*a*, standing still without a vertical translation inside the lower slit 9 of the intermediate lower body 7"*a*, to meet in its way the inclined tooth 15'. Said inclined tooth 15' modifies the way of the lower pin 5' on the translatory sliding inclined 20' line, along the helicoidal groove 16' of the outer lower body 13'*a*, with a corresponding beginning of vertical translation towards the bottom, inside the lower slit 9;

b) correspondingly, the upper pin 5 covers the same brief distance of horizontal translatory sliding 20, along the upper annular groove 14 of the upper outer body 13*a*, standing still without a vertical translation inside the upper slit 8' of the intermediate upper body 7'*a*, to follow parallely, controlled by the other lower pin 5', the same distance of the inclined translatory sliding 20' line along the free area between the pair of the outer bodies 13 and 13'*a*, with a corresponding beginning of vertical translation towards the bottom, inside groove 11' of the central wall 10*a*, then to slide along the helicoidal groove 17' of the lower outer body 13'*a*, with a corresponding vertical translation towards the bottom, inside the lower slit 9'.

Continuing the motion of the central wall 10*a* and of respective portions, upper 7'*a* and lower 7"*a*, of the intermediate body towards the right we obtain, as illustrated in FIGS. 13 and 13*a*, that:

a) the lower pin 5' stops at the lower limit of the helicoidal groove 16', adjacent to the internal annular step 18' of the lower outer body 13'*a*, and near the lower outer annular tooth 12' of the lower intermediate body 7"*a;* b) correspondingly, the upper pin 5 stops at the lower limit of the helicoidal groove 17', of an lower height equal to the distance "D" in comparison with the lower limit of the helicoidal groove 16'.

In that position the stick holder 1 is completely translated towards the bottom, with its lower edge projected in respect to the lower outer annular tooth 12' of the lower intermediate body 7"*a*, with its stick 3' completely out in lower position, while the opposed stick 3 stays in an internal position to the lower intermediate body 7"*a*.

Inverting the motion of the central wall 10*a* and of the respective portions, upper 7'*a* and lower 7"*a*, of the intermediate body towards the left, with a mutual rotating motion in respect to the lower outer tubular body 13'*a*, we obtain that pins 5' and 5, and the relative stick holder 1, rise along the respective annular grooves 16' and 17', and vertical slits 9 and 9', to return to the starting point, as it is illustrated in FIGS. 11 and 11*a*.

Continuing the motion of the central wall 10*a* and of the respective portions, upper 7'*a* and lower 7"*a*, of the intermediate body towards the left, besides the non-use position, and forcing the slight relieves 19' and 19, made inside the annular grooves 14' and 14, the guide pins 5' *e* 5 cover, along these annular grooves 14' and 14, the horizontal lines of translatory sliding 20 until they meet, to stop however, the inclined tooth 15'.

If instead, for example, a mutual rotating motion is impressed between the two outer bodies, upper 13 and lower 13', without committing or being integral with them the central wall 10 and its respective portions, upper portion 7'*a* and lower portion 7"*a*, of the intermediate body of FIG. 11 so that, as it is illustrated in FIG. 11*a*, the upper outer body 13*a* moves towards the right or the left in respect of the corresponding opposite lower outer body 13'*a*, we obtain that the pins 5 and 5' cover only the way of the horizontal translatory sliding 20, along these annular grooves 14' and 14 of the respective outer bodies upper 13*a* and interior 13'*a*, staying still without axial translation inside the respective slits 8' and 9 of the intermediate body 7'*a* and 7"*a* until they find in their paths the respective inclined teeth 15 and 15', for stopping.

A mutual motion only between the two opposite outer bodies, upper 13 and lower 13', without letting the central wall 10 and the respective portions, upper 7'*a* and lower 7"*a* of the intermediate body of FIG. 11 be integral with one of them, it does not impress an axial translation motion, towards the top or towards the bottom, of pins 5, 5' and of its stick holder 1.

Said motion of axial translation is possible only with a reciprocal motion between the central wall 10 and the respective portions, upper 7'*a* and lower 7"*a*, of the intermediate body, in respect of one of the two opposite outer bodies, 13 or 13'.

FIG. 14 illustrates the roto-translatory mechanism of FIG. 11 in which the pair of outer bodies 13, 13', having internal helicoidal grooves, are covered with a pair of metal tubular shells covering 21 and 21', with the purpose of improving the finishing appearance touch of the container.

FIG. 15 illustrates the roto-translatory mechanism of FIG. 14 provided with the lower cap/base 22', one of the two caps/bases having simultaneous function as cap as well as of base, consisting in a tubular body having a upper open end and a closed lower one, inserted in the lower portion of the roto-translatory mechanism so that it covers the outer body 13' when closing it, and its relative metal shell covering 21', until it becomes fixed on the edge of the central wall 10.

Said cap/base 22' is provided, on its inner bottom, with annular sectors 23' projected towards its open end so that when closing the open ends of these sectors of annular walls can adhere elastically, with a determinate friction, on the inner tubular wall of the lower intermediate body 7", said friction can make integral the lower intermediate body 7" and the cap/base 22'.

The roto-translatory motion of the stick holder, besides being exercised by the reciprocal motion between the upper outer body 13 and the central wall 10, can be also exercised by the reciprocal motion between the upper outer body 13 and the cap/base 22', because said last one has been made integral through the friction to the central wall 10 and to the respective portions, upper 7'*a* and lower 7"*a*, of the intermediate body.

FIG. 16 illustrates the container of FIG. 15 in which, following up a mutual rotating motion between the upper outer body 13 and central wall 10 or the cap/base 22', the stick holder 1 is completely translated towards the upper open end of said container, with its upper edge projected in comparison with the upper outer annular tooth 12 of the upper intermediate body 7'.

Its upper stick 3 is completely out in upper position, while the opposed lower stick 3' remains in an internal position of the upper intermediate body 7'.

FIG. 17 illustrates the roto-translatory mechanism of FIG. 14 in which the cap/base 22 is inserted in closing on the upper portion of the roto-translatory mechanism so that the sectors of annular walls 23, projected from its inner bottom towards its open end, have been inserted with a determinate friction on the inner wall of the upper intermediate body 7', said friction makes integral said cap/base 22 with said upper intermediate body 7'.

Following a reciprocal roto-translatory motion, between the lower outer body 13' and the central wall 10 or the cap/base 22, the stick holder 1 is completely translated towards the open lower end of said container, with its lower edge projected in comparison with the lower outer annular tooth 12' of the lower intermediate body 7".

Its lower 3' stick is completely out in lower position, while the opposed upper stick 3 stands in an internal position of the lower intermediate body 7".

FIG. 18 illustrates the plain view, only the left half, enlarged with scale 2:1, according to the XVIII-XVIII plan, of the only two bodies lower cap 22' and lower end inner body 7" of FIG. 16, where to simplify the representation the metal tubular shell body 21 and the outer lower body 13' are not illustrated.

What has been illustrated for the lower end is also valid for the opposed upper end, to show how to improve the means act to make more solid, without the possibility of reciprocal annular sliding, the caps/bases, 22, 22', with the intermediate body, through the upper ends 7' and lower 7".

These means, consist in a knurling or series of ribs 24, for example verticals, made on the ends of the inner wall 7' and 7", bounded with a corresponding knurling or series of ribs 25, for example verticals, made on the ends of the outer walls of the annular sectors, 23, 23', in the inner bottom of the caps/bases 22, 22'.

These means, not illustrates in the figures attached, they could eventually consist in a knurling or series of ribs 24, for example verticals, made on the ends of the central wall 10, bounded with a corresponding knurling or series of ribs 25, for example verticals, made on the ends of the inner walls of the Caps/Bases 22, 22'.

Said invention has been described as an explanatory one but it is not limitative, according to its favourite forms of creation, but it goes without saying that variations and/or changes can be done by experts of the artwork without, for said reason, passing the circle of protection, as explained in the attached claims.

LEGEND

1. Stick holder 1.

1*a* Plane development of the circumference of the inner wall of the stick holder 1, with inclined hatched dense at 90°.

2. Tubular body 2 of the stick holder.

3 and 3' Double sticks of cosmetic products 3 and 3'.

3" Product 3", consists in a dripping of melted cosmetic product or of a different product, a compound to make a single body with both bottoms of the sticks.

3*a* Application tool of cosmetic products 3*a*, consists in a brush for cosmetic use.

3*b* Application tool of cosmetic products 3*b*, consists in a small bar provided with a small sponge.

3*c* Application tool of cosmetic products 3*c* consists in a brush for mascara.

3*d* Application tool of cosmetic products 3*d*, consists in a pencil.

4 Central level of the support surface of the double sticks.

4' and 4" Two opposing portions of annular edges 4' and 4" that function as central support level of respective sticks of cosmetic products 3 and 3'.

5 and 5' A pair of guide pins 5, upper, and 5', lower, made on the outer wall of the tubular body 2, opposed from the axle and from the central level.

6 and 6' Two opposite openings 6 and 6' realised on the central level of the tubular body 2, positioned between the two opposing portions of annular edges 4 and 4', that function as air discharging when each end of the two sticks 3 and 3' are inserted.

7 Intermediate body 7, tubular.

7' and 7" Wall portion 7' upper and wall portion 7" lower, of the intermediate body 7 with minor diameter.

7'*a* and 7" Plane development of the circumference of wall 7'*a* upper portion and wall 7"*a* lower portion, of the intermediate body 7 with minor diameter, hatched with spaced dots.

8 and 8' A pair of guide slits 8 and 8', opposite, verticals, realised on upper tubular wall of the intermediate body 7.

9 and 9' A pair of guide slits 9 and 9', opposite, verticals, realised on the lower wall of the intermediate body 7.

10 Central wall 10, tubular, of wider diameter, of the intermediate body 7.

10*a* Plane development of the inner circumference of the central wall 10 of the intermediate body 7, with dense hatched dots.

11, 11' Pairs of guide grooves 11 and 11', opposite, vertical, realised inside the central wall 10, tubular of wider diameter, of the intermediate body 7.

12 *e* 12' Outer annular tooth, upper 12, lower 12', provided on the open ends, upper and lower, of the intermediate tubular body 7.

13 and 13' Outer bodies 13, 13', tubular, same, separate and put in opposite position.

13*a*, 13'*a* Plane development of the circumference of the inner wall of the outer bodies 13 and 13', with inclined hatched spaced at 0°.

14 and 14' Internal annular grooves 14 and 14' of the outer bodies 13, 13'.

15 and 15' Internal relieves in the shape of inclined tooth 15 and 15', that interrupt the internal annular grooves 14 and 14'.

16 and 16' Helicoidal internal grooves 16 and 16', of the outer bodies 13, 13'.

17 and 17' Helicoidal internal grooves 17 and 17', of the outer bodies 13, 13', asymmetrically opposite to the pair of internal helicoidal grooves 16 and 16'.

18 and 18' Internal annular steps 18 and 18', adjacent to each open end faced toward the outer portion of the outer bodies 13, 13'.

19 and 19' Slight relieves 19 and 19' made inside the annular grooves 14 and 14'.

20 and 20' Line of translational sliding, horizontal 20, inclined 20', of the guide pins 5 and 5'.

21 and 21' A pair of metal tubular shells covering 21 and 21' of the outer bodies 13 and 13'.

22 and 22' Caps/bases, upper and lower, having simultaneous function as cap as well as of base.

23 and 23' Annular sectors 23, 23' in the inner bottom of the caps/bases 22, 22' projected through the open ends to adhere with clutch on the inner walls of the upper intermediate body 7' and lower 7".

24 Knurling or series of grooves made on the ends of the inner upper wall 7' and lower 7".

25 Knurling or series of ribs made on the ends of the outer walls of the annular sectors 23, 23', in the inner bottom of the caps/bases 22, 22'.

"D" Distance "D" between the guide pins pair 5 and 5', or distance "D" between the final ends of the internal helicoidal grooves 16, 16' and 17, 17'.

The invention claimed is:

1. Container for the roto-translatory motion of a tubular stick holder (1), comprising:

a stick holder having an outer wall provided with guide pins (5, 5'), said stick holder (1) being configured to axially slide inside an intermediate tubular body (7), said intermediate body comprising:

an outer wall with a diameter (7'; 7") and vertical guide slits (8, 8'; 9, 9'); and a central wall (10), having a diameter greater than the diameter of said outer wall of said stick holder; and wherein said intermediate body (7) being configured to axially rotate inside an outer body (13, 13'), wherein said outer body (13, 13'):

has a tubular shape, with both ends open, and comprises an inner wall provided with helicoidal guide grooves (16, 17; 16', 17') and portions of annular guide grooves (14; 14'), said annular guide grooves (14, 14') being adjacent to the open end of said outer body (13, 13') faced towards inside of the container, wherein said outer body (13; 13') is configured to be covered by a closure cap (22; 22') of the container open end, wherein said guide pins (5, 5') cross said vertical guide slits (8, 8'; or 9, 9') to slide inside both helicoidal guide grooves (16, 17; 16', 17'), to the annular guide grooves (14; 14'), prompting a mutual rotating motion between the outer body (13; 13') and the intermediate body (7), and/or said central wall (10) of said intermediate body, and wherein the stick holder (1) is controlled to axially move inside the intermediate body;

said container being further characterized in that said stick holder (1), is configured to house, in a position opposed with respect to the central plane of a support surface (4), a pair of sticks (3, 3'), or a pair of cosmetic product application tools (3*a*, 3*b*, 3*c*, 3*d*), or a combination thereof, and provides at least a pair of guide pins (5, 5'), in a position opposed with respect to the longitudinal axis of said body (1), and in a position opposed with respect to the central plane of the support surface (4) of said pair of sticks and/or cosmetic product application tools, longitudinally spaced of a distance (D), so that one of said pair of guide pins (5) is in an upper position and the other of said pair of guide pins (5') is in a lower position.

2. Container according to claim 1, characterized in that said intermediate body (7) is provided with:

a pair of opposite, vertical guide slits (8 and 8'), on an upper portion (7') of the outer wall of said intermediate body;

a pair of opposite, vertical guide slits (9 and 9') on a lower tubular wall portion of the outer wall (7") of said intermediate body;

a central wall (10) on a central portion of said intermediate body, having a larger outer diameter than said outer wall, wherein the pairs of slits (8, 8' and 9, 9') are symmetrical with respect to said central wall (10); and a pair of opposite, vertical guide grooves (11 and 11'), located inside said central wall (10), aligned with respect to the pairs of guide slits (8, 8' and 9, 9').

3. Container according to claim 2, characterized in that that said intermediate body (7) is further provided with:

outer upper (12) and lower (12') annular teeth, provided on the open ends of the upper (7') and lower (7") wall portions of the intermediate body (7), wherein the upper tooth (12) is interrupted by at least an upper guide slit (8), the lower tooth (12') is interrupted by at least a lower guide slit (9').

4. Container according to claim 1, characterized in that that one pair of equal, separate and in opposite positions tubular upper (13) and lower (13') outer bodies, with open ends, at a distance from the central wall (10), are provided with:

a pair of portions of annular grooves (14 and 14') adjacent to the respective open ends faced towards the central wall (10), interrupted by respective internal relieves, having the shape of an inclined tooth (15 and 15');

a pair of internal helicoidal grooves (16 and 16') with ends that:

a) on one side cross the pair of annular grooves (14 and 14'), and in a position adjacent to the tooth shaped internal relieves (15 and 15'), so that one side of the inclined tooth (15) or (15'), be the continuation of the helicoidal groove side (16 or 16'), b) on the other side they stop at a final distance just before the internal annular steps (18 and 18'), adjacent to each open end faced towards the outer side;

a pair of helicoidal internal grooves (17 and 17') asymmetrically opposite to the pair of internal helicoidal grooves (16 and 16') with ends that:

a) on one side cross the pair of annular grooves (14 and 14'), b) on the other side they stop at a set final distance before the internal annular steps (18 and 18'), said final distance being lower than a distance (D) with respect to the final distance between the pair of internal helicoidal grooves (16 and 16') and is equal to the distance (D) between the pair of guide pins (5 and 5').

5. Container according to claim 1, characterized in that that one pair of caps, said caps also acting as bases, caps/bases (22, 22'), is configured to be inserted for closure on the upper and lower portions of the container, each of said caps/bases comprising an annular wall sector (23, 23'), projecting from an inner bottom towards an open end of said cap/base, so that upon closure of said upper or lower portion of said container there is friction between the inner walls of the internal upper (7') and lower (7") ends, of the intermediate body and said annular wall sector of said cap/base, said friction being able of making integral said caps/bases (22, 22') with said intermediate body ends, so that the roto-translatory motion of the stick holder, besides being exercised by the reciprocal motion between the upper outer body (13 or 13') and the central wall (10), can be also exercised by the motion each other between the upper outer body (13) and the lower cap/base (22'), or respectively between the lower outer body (13') and the upper cap/base (22).

6. Container according to claim 1, characterized in that that stick holder (1) is provided with a central support plane for the respective double sticks of cosmetic products (3 and 3'), comprising two opposed portions of annular edges (4 and 4'), faced towards a longitudinal axis, and of two opposite openings (6 and 6') realised between the two opposed portions of annular edges (4 and 4'), acting as air discharge when each end of the two sticks (3 and 3') are inserted to lean on said two double opposed portions of annular edges.

7. Container according to claim 6, characterized in that that the cosmetic product stick (3) is opposed to a tool for application of cosmetic product, comprising:

a brush, or small brush, for cosmetic use (3*a*), or a small bar provided with a small sponge (3*b*), or a small bar provided with a mascara brush (3*c*), or a pencil (3*d*), or a pencil core, or other possible similar application tools of a cosmetic product.

8. Container according to claim 7, characterized in that that between the two opposed sticks (3, 3') bottoms, or the stick (3) with a opposed cosmetic product application tool (3*a*, 3*b*, 3*c*, 3*d*), a product (3") is interposed, during the assemblage operation, said product (3") comprising:

a) a dripping of the melt cosmetic product, that amalgamates with the two stick bottoms (3, 3') of the same cosmetic product, making a single body during a cooling of the melt cosmetic product, b) an amalgam of different product that has in any case the purpose to create a single body with both bottoms of the sticks (3, 3') opposed, or of stick (3) with opposed application tool of cosmetic product (3*a*, 3*b*, 3*c*, 3*d*).

9. Container according to claim 1, characterized in that that when both pins (5, 5') are provided within the respective upper (14) and lower (14') annular grooves, the stick holder (1) is in a central resting position, or in a its non-use position, so that both upper (3) and lower (3') sticks are inside the (7') upper and (7") lower wall portions of the intermediate body (7), with both ends closed by each upper (22) and lower (22') caps/bases.

10. Container according to claim 9, characterized in that stopping means are provided, said stopping means being passed on with a control of mutual rotation between one of the two outer tubular bodies (13 or 13') and the central wall (10), at least one of them comprising slight relieves (19) and (19'), inside the annular grooves (14) and (14'), in a position outer and adjacent with respect to the guide pins (5, 5'), to avoid the stick holder (1) being accidentally moved along the axis.

11. Container according to claim 4, characterized in that that when the stick holder (1) is in a central resting position, said stick holder is configured to undergo:

a) a clockwise rotating motion between the intermediate body (7) and the upper outer body (13), wherein:

the upper pin (5) moves, and after a horizontal sliding (20), along the upper annular groove (14), it meets the inclined tooth (15), that modifies the path of the upper pin on the inclined sliding (20') along the helicoidal groove (16) of the upper outer body (13), with vertical translation in the upper slit (8'), stopping at the upper limit of the helicoidal groove (16), adjacent to the internal annular step (18) of the upper outer body (13), and near the upper outer annular tooth (12) of the upper intermediate body (7');

the lower pin (5') consequently moves, and after a horizontal sliding (20), along the lower annular groove (14'), parallely follows, controlled by the other upper pin (5), the path of said upper pin on the inclined sliding (20') along the free zone between the pair of the eternal body (13) and (13'), with vertical translation towards the top inside groove (11) of the central wall (10), then slides along the helicoidal groove (17) of the upper outer body (13), with a corresponding vertical translation towards the top, inside the upper slit (8), stopping at the upper limit of the helicoidal groove (17) of a reduced height "D" in comparison with the upper limit of the helicoidal groove (16);

in said position of the pins (5, 5'), the stick holder (1) is completely translated towards the top, with the upper edge of said stick holder projecting with respect to the upper outer annular tooth (12) of the upper intermediate body (7'), with the stick (3) completely out in upper position, while the opposed stick (3') stays in an internal position to the upper intermediate body (7');

b) after an inverted anticlockwise rotating motion, always between the intermediate body (7) and the upper outer body (13), said pins (5, 5') move, lowering along the respective annular grooves (16) and (17), and upper vertical slits (8') and (8), to turn back to the starting point, in a non-use position;

c) continuing the anticlockwise motion between the intermediate body (7) and the upper outer body (13), pins (5, 5') move, besides the non-use position, forcing the slight relieves (19) and (19'), made inside the annular grooves (14) and (14'), covering the lines of horizontal sliding (20), until they stop when they meet the inclined tooth (15).

12. Container according to claim 1, characterized in that that, when the stick holder (1), that is in a central resting position, is subjected to:

a) a clockwise rotating motion between the intermediate body (7) and the lower outer body (13'), it is obtained that:

the lower pin (5') moves, and after a horizontal sliding (20) along the lower annular groove (14'), meets the inclined tooth (15'), that modifies the path of said lower pin on the inclined slide (20') along the helicoidal groove (16') of the lower outer body (13'), with vertical translation in the lower slit (9), stopping at the lower limit of the helicoidal groove (16'), adjacent to the internal annular step (18') of the lower outer body (13'), and near the lower outer annular tooth (12') of the lower intermediate body (7");

the upper pin (5) consequently moves, and after a horizontal sliding (20), along the upper annular groove (14), parallely follows, controlled by the other lower pin (5'), the path of the upper pin on the inclined sliding (20') along the free zone between the pair of the outer body (13) and (13'), with vertical translation towards the bottom inside of the groove (11') of the central wall (10), then slides along the helicoidal groove (17') of the lower outer body (13'), with a corresponding vertical translation towards the bottom, in the lower slit (9), stopping at the lower limit of the helicoidal groove (17'), of a reduced height "D" in comparison with the lower limit of the helicoidal groove (16');

in said position covered by pins (5', 5) the stick holder (1) is completely translated towards the bottom, with the lower edge of said stick holder projected in comparison with the lower outer annular tooth (12') of the lower intermediate body (7"), with the stick (3') completely out in lower position, while the opposed stick (3) stays in an internal position to the lower intermediate body (7");

b) in a following inverted rotating anticlockwise motion, always between the intermediate body (7) and the lower outer body (13'), pins (5', 5) move, rising along the respective annular grooves (16') and (17'), and lower vertical slits (9) and (9'), to turn back to the starting point, in a non-use position;

c) continuing the motion anticlockwise between the intermediate body (7) and the lower outer body (13'), guide pins (5') and (5) move, besides the non-use position, forcing the slight relieves (19') and (19), made inside the annular grooves (14') and (14), covering the lines of horizontal sliding (20), until they stop when they meet the inclined tooth (15').

13. Container according to claim 1, characterized in that, to prevent annular sliding between the caps/bases (22, 22') and the intermediate body (7), there is a series of ribs (24), for example vertical ribs, made on the ends of the inner walls (7', 7"), of the intermediate body (7), configured to engaged with a corresponding series of ribs (25), for example vertical ribs, made on the ends of the outer walls of the annular sectors (23, 23'), in the inner bottom of the caps/bases (22, 22').

14. Container according to claim 1, characterized in that to prevent reciprocal annular sliding between the caps/bases (22, 22') and the intermediate body (7), in the intermediate body comprises knurling or opposed grooves/ribs made on opposed portions of walls thereof.

15. Container according to claim 1, characterized in that that the cosmetic product stick (3) is opposed to a tool for application of cosmetic product, comprising:

a brush, or small brush, for cosmetic use (3*a*), or
a small bar provided with a small sponge (3*b*), or
a small bar provided with a mascara brush (3*c*), or
a pencil (3*d*), or a pencil core, or
other possible similar application tools of a cosmetic product.

* * * * *